US005908245A

United States Patent [19]

Bost et al.

[11] Patent Number: 5,908,245

[45] Date of Patent: Jun. 1, 1999

[54] RECLOSABLE PLASTIC BAG

[76] Inventors: Charles H. Bost, 1520 Eckert Dr., Winter Haven, Fla. 33881; Marcella Kirkland, 169 Whitman Rd., Winter Haven, Fla. 33884

[21] Appl. No.: 09/088,004

[22] Filed: Jun. 1, 1998

[51] Int. Cl.[6] ..... B65D 33/14

[52] U.S. Cl. ..... 383/9; 383/65; 206/554; 493/199; 493/214

[58] Field of Search ..... 383/9, 63, 65; 206/554; 493/199, 214, 200–220

[56] References Cited

U.S. PATENT DOCUMENTS

| | | | |
|---|---|---|---|
| 2,666,466 | 1/1954 | Sharat | 383/65 |
| 2,789,609 | 4/1957 | Post | 383/65 |
| 2,878,849 | 3/1959 | Lingenfelter et al. | 383/9 |
| 3,313,472 | 4/1967 | Tjerneld et al. | 383/9 |
| 3,346,883 | 10/1967 | Ersek | 383/65 |
| 3,791,337 | 2/1974 | Schamblin | 383/9 |
| 4,290,467 | 9/1981 | Schmidt | 383/9 |
| 4,479,244 | 10/1984 | Ausnit . | |
| 4,756,629 | 7/1988 | Tilman et al. . | |
| 4,787,755 | 11/1988 | Branson | 383/65 |
| 4,792,240 | 12/1988 | Ausnit | 383/63 |
| 4,846,586 | 7/1989 | Bruno | 383/9 |
| 4,925,316 | 5/1990 | Van Erden et al. . | |
| 5,129,734 | 7/1992 | Van Erden . | |
| 5,480,230 | 1/1996 | May . | |
| 5,511,884 | 4/1996 | Bruno et al. . | |
| 5,544,752 | 8/1996 | Cox . | |

*Primary Examiner*—Stephen P. Garbe
*Attorney, Agent, or Firm*—William M. Hobby, III

[57] ABSTRACT

A reclosable plastic bag has a bottom, sides, and a mouth and has a reclosable zipper for opening and resealing the plastic bag mouth. Heat seals are placed at each end of the zipper and each heat seal has an aperture therethrough and may form a pair of protruding hanging tabs. A protruding center tab extends from each side of said bag above the zipper and extending above the mouth of the bag such that each tab can be grabbed for opening the reclosable zipper. A method of making a reclosable zipper bag includes the steps of making a plastic bag having bottom, sides, and a mouth and having a reclosable zipper for opening and resealing the plastic bag mouth and heat sealing each end of the plastic bag zipper to seal the two sides together and punching an aperture in each of the heat seals and then cutting a protruding center tab in the plastic bag and forming an aperture through the center tab to form a reclosable plastic bag which is easily opened and resealed and has supporting tabs.

6 Claims, 1 Drawing Sheet

RECLOSABLE PLASTIC BAG

BACKGROUND OF THE INVENTION

The present invention relates to reclosable plastic bags and especially to a reclosable plastic bag which is easily opened and resealed and which is easy to store.

Reclosable plastic bags are well known and are generally formed of plastic, such as polyethylene, having a bottom and sides with an open mouth which is closed by a resealing zipper. Zippers are typically plastic strips, one side having a sized and shaped groove extending the length thereof and the other side having a protruding rib which is pushed into the groove on the opposite side to provide a seal between the sides covering the mouth of the bag. The bags can thereby be repeatedly opened and closed.

Many prior art patents deal with reclosable plastic bags and include various types of profiles designed to be opened and closed repeatedly. The prior art bags, however, sometimes are difficult to open and reclose and are sometimes cumbersome to store.

Prior art reclosable plastic bags can be seen in the Bruno et al., U.S. Pat. No. 5,511,884, for a reclosable plastic bag with easy open and easy reclose profiles which has male and female interlocking profiles designed to be easily opened and closed. This bag includes within the mating profiles a selective non-engaging section such that the profiles can not interlock at that section to permit a user to more easily open the bag when the separating action of the profiles is initiated at the non-engaging section. The non-engaging section also permits air to escape as the bag and profiles are pressed together to close the bag. The VanErden et al. U.S. Pat. No. 4,925,316, is a reclosable bag having an outer reclosable zipper-type closure and an inner non-reclosable closure. A nonreclosable closure can be opened and the bag then resealed with the outer reclosable zipper. The Van Erden U.S. Pat. No. 5,129,734, is a sealed system for block cheese which uses a flexible film doubled along one edge with the end seals joining the ends of the film and a reclosable zipper along the other remaining edge. The zipper is longer than the space between the end seals so that as the zipper is opened, a mouth is formed sufficiently large to allow for insertion and removal of a block. At the ends of the zippers are spot seal joining layers of film. The enclosed Ausnit U.S. Pat. No. 4,479,244, is an easy open and reclosable plastic bag in which the zipper portion has a frictional surface for applying local force of opposing directions parallel to a rib and groove to cause a curl in the interlocked rib and groove to cause them to separate by relatively sliding the rib and groove axially relative to each other. The Tilman et al. U.S. Pat. No. 4,756,629, is a system for producing a non-compatible zipper film having spot seals at each end of the zipper portion. The May U.S. Pat. No. 5,480,230, is a double header package having a tear bead and provides a hanging hole. The Cox U.S. Pat. No. 5,544,752, is a reclosable storage bag which permits manual evacuation of air from the bag and provides a rough surface gripping pad on one end of the mouth opening of the bag.

In contrast, the present invention is for a reclosable plastic bag which provides integrated heat seals for sealing each of the ends of the zipper so that they easily align for reclosing the bags while at the same time using the heat seals to punch apertures therethrough for hanging the bag and also has center non-attached tabs on each side of the opening of the bag for easily grasping the tabs to open the bag. The center tabs also have an aperture therethrough for hanging the bag.

SUMMARY OF THE INVENTION

A reclosable plastic bag has a bottom, sides, and a mouth and has a reclosable zipper for opening and resealing the plastic bag mouth. Heat seals are placed at each end of the zipper and each heat seal has an aperture therethrough and may form a pair of protruding hanging tabs. A protruding center tab extends from each side of the bag above the zipper and extending above the mouth of the bag such that each tab can be grabbed for opening said reclosing the zipper. A method of making a reclosable zipper bag includes the steps of making a plastic bag having bottom, sides, and a mouth and having a reclosable zipper for opening and resealing the plastic bag mouth and heat sealing each end of the plastic bag zipper to seal the two sides together and punching an aperture in each of the heat seals and then cutting a protruding center tab in the plastic bag and forming an aperture through the center tab to form a reclosable plastic bag which is easily opened and resealed and has supporting tabs.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
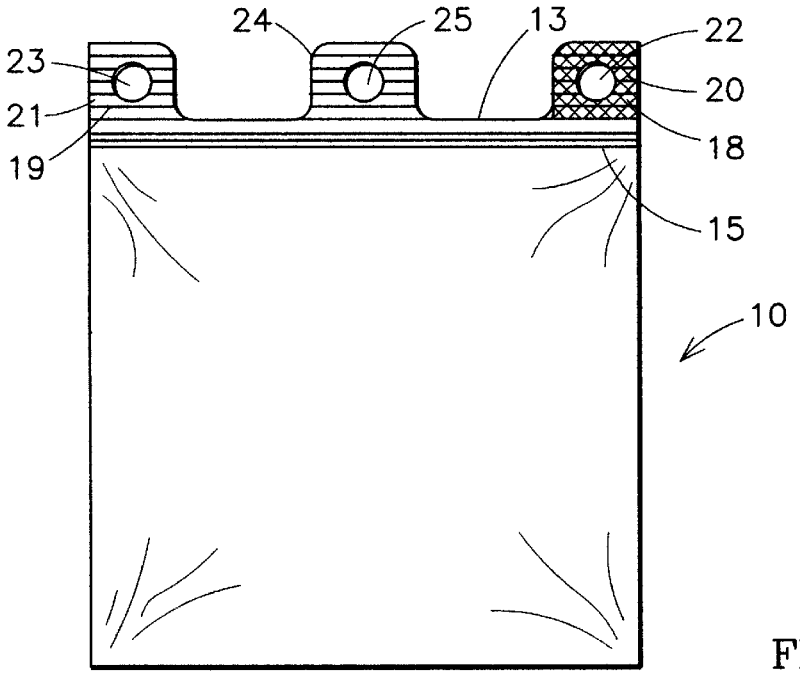
FIG. 1 is a side elevation of a plastic bag in accordance with the present invention.
Figure 2:
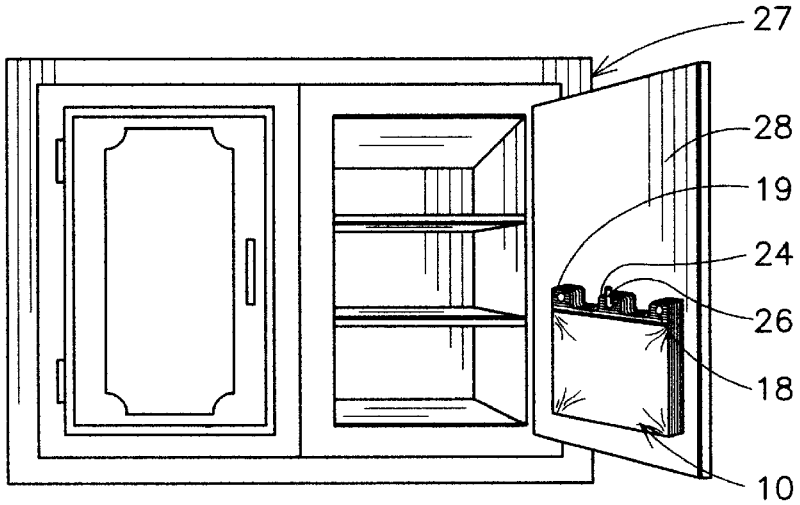
FIG. 2 is a front elevation of a cabinet having the bags of FIG. 1 stored therein.
Figure 3:
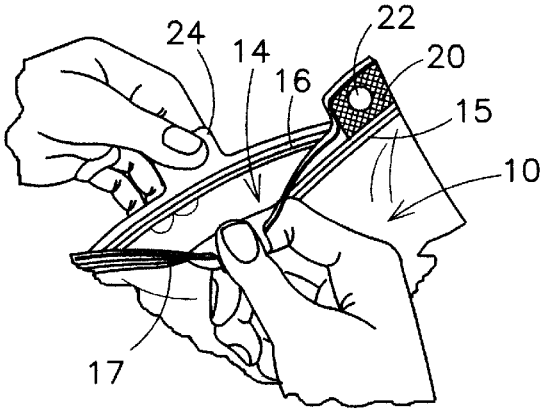
FIG. 3 is a partial perspective view of the bag of FIG. 1 being opened.

Referring to the drawings, FIGS. 1–4, a reclosable plastic bag 10 may be made of polyethylene or any plastic film desired and has a pair of sides 11, a bottom 12, and a top 13 having a mouth 14 entrance into the plastic bag. The mouth 14 has a zipper 15 adjacent thereto having one side having an elongated groove 16 formed therein and the other side having an elongated zipper rib 17 for fitting the elongated groove 16 for forming a resealable zipper. The bag has a heat seal portion 18 on one end and a heat seal portion 19 on the other end thereof overlapping each end of the zipper 15 for sealing the zipper portions together to form an engaging alignment for the opposite portions of the zipper when closing the zipper to reseal the bag 10. Each heat sealing portion 18 and 19 is placed on a tab extension 20 and 21. Tab 20 has an aperture 22 punched therein while the tab 21 has an aperture 23 punched therethrough. The top of the bag is formed by cutting out the material around the tabs and around a central tab 24 which has been cut in each side of the plastic bag but has not been sealed together. The tab 24 has an aperture 25 cut through both of the tab portions and makes an easy opening handle which can be grabbed with each portion of the tab 24 to pull the bag apart, as shown in FIG. 3.

Figure 4:
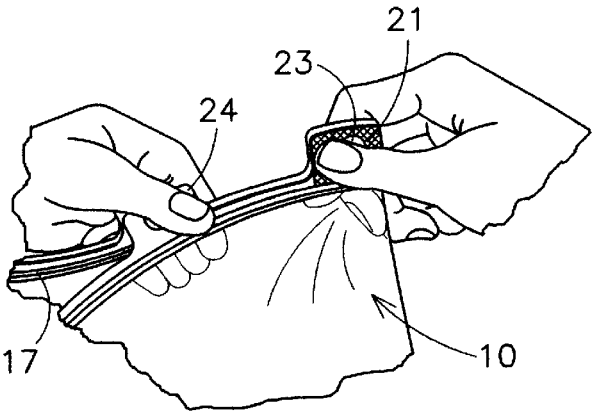
FIG. 4 is a partial perspective view of the bag of FIG. 1 being closed.

The closing of the bag is simplified by the heat seal section 18 and 19 overlapping the ends of the zipper portion so that the zipper portions align from each end and can be grasped, as shown in FIG. 4, on the heat seal portion and pulled from one end to provide a quick mating zipper portion.

The apertures 22, 25, and 23 can be used to store the bags or materials in the bag by placing the aperture onto a hook 26 placed on the inside of a cabinet 27, cabinet door 28, as seen in FIG. 2. To use a bag, a person merely has to open the door 28 of the cabinet 27 and grab the next bag 10 off the hook 26.

The bag can be opened by grasping the two portions of the handle tab 24 and pulling them apart to open the bag 10 mouth 14 by separating the zipper 15 portion. Once the bag is filled, it can be resealed rapidly by grasping one end, as shown in FIG. 4, and merely pulling along the zipper which automatically aligns because the ends of the zipper are held together by the heat seal portions 18 and 19 at each end of the mouth of the bag.

The method of making the present bag can be forming the plastic bag 10 with the sides 11 and a sealed bottom 12 and an open mouth 14 having a zipper formed therein and then cutting the top portion of the plastic bag above the zipper to form three tabs, as shown in FIG. 1. The two end tabs can be heat sealed overlapping each end of the zipper to seal the zipper portions together while simultaneously punching or cutting an aperture 20 and 23 in the heat seal tab portions. An aperture 25 can then be cut or punched in a pair of unsealed tabs 24 to allow a place for storing the bag, as shown in FIG. 2.

It should be clear at this time that a reclosable plastic bag has been provided which allows for the easy opening and easy reclosing of the bag as well as for convenient storage of the bag. However, the present invention is not to be considered limited to the forms shown which are to be considered illustrative rather than restrictive.

We claim:

1. A reclosable plastic bag having a bottom, sides, and a mouth comprising:

a reclosable zipper having a pair of ends for opening and resealing said plastic bag mouth;

spot seals at each end of said zipper, at least one of said spot seals having an aperture therethrough; and a protruding center tab extending from each side of said bag above said zipper and extending above the mouth of said bag, each said tab being located between the ends of said zipper and each said tab having a aperture therethrough; whereby a reclosable plastic bag can be easily opened and resealed and can be hung on a supporting prong.

2. A reclosable plastic bag in accordance with claim 1 in which each said spot seal has an aperture therethrough.

3. A reclosable plastic bag in accordance with claim 2 in which each said each said center tab is aligned with the other center tab and the aperture in each said center tab is aligned with the other.

4. A reclosable plastic bag in accordance with claim 3 in which each said each spot seal on each end of said zipper forms an extending tab extending above said zipper and above said bag mouth.

5. A reclosable plastic bag in accordance with claim 4 in which each said aperture in each said spot seal is in said extending tab.

6. A method of making a reclosable plastic bag comprising the steps of:

making a plastic bag having a bottom, sides, and a mouth and having a reclosable zipper having a pair of ends for opening and resealing said plastic bag mouth;

spot sealing each end of said plastic bag zipper, and punching an aperture in each spot seal; and cutting a protruding center tab in said plastic bag extending above said zipper and above the mouth of said bag to form an easy opening handle located between the ends of said zipper; and punching an aperture through said cut center tab; whereby a reclosable plastic bag is formed which can be easily opened and resealed and can be hung on a supporting prong.

* * * * *